US008607670B2

(12) United States Patent
Stawarski

(10) Patent No.: US 8,607,670 B2
(45) Date of Patent: Dec. 17, 2013

(54) DAMAGED FASTENER EXTRACTOR

(76) Inventor: Rafal Stawarski, Roselle, IL (US)

( * ) Notice: Subject to any disclaimer, the term of this patent is extended or adjusted under 35 U.S.C. 154(b) by 493 days.

(21) Appl. No.: 13/092,682

(22) Filed: Apr. 22, 2011

(65) Prior Publication Data

US 2012/0210826 A1 Aug. 23, 2012

Related U.S. Application Data

(60) Provisional application No. 61/444,332, filed on Feb. 18, 2011.

(51) Int. Cl.
*B25B 13/50* (2006.01)
*B25B 13/06* (2006.01)
*B25B 23/08* (2006.01)

(52) U.S. Cl.
USPC ..... 81/53.2; 81/121.1; 81/441

(58) Field of Classification Search
USPC ..... 81/53.2, 121.1, 441
See application file for complete search history.

(56) References Cited

U.S. PATENT DOCUMENTS

| | | | | | |
|---|---|---|---|---|---|
| 906,040 | A | * | 12/1908 | Lucas | 81/120 |
| 1,590,200 | A | * | 6/1926 | McGuckin | 81/120 |
| 3,161,090 | A | | 12/1964 | McLellan | |
| 3,913,427 | A | | 10/1975 | Brase | |
| 3,996,819 | A | * | 12/1976 | King | 81/124.6 |
| 4,057,890 | A | | 11/1977 | Feen | |
| 4,947,712 | A | | 8/1990 | Brosnan | |
| 5,361,657 | A | | 11/1994 | Terry | |

(Continued)

FOREIGN PATENT DOCUMENTS

| | | |
|---|---|---|
| AU | 715789 | 2/2000 |
| AU | 2005/242115 | 6/2006 |

(Continued)

*Primary Examiner* — Monica Carter
*Assistant Examiner* — Danny Hong
(74) *Attorney, Agent, or Firm* — Kinne IP Group, P.C.; Charles C. Kinne

(57) ABSTRACT

A damaged fastener extractor is provided with a body defining generally cylindrical coordinates $\Theta$, Z and R about an axis and having a rear body portion communicating with a front body portion. The rear body portion has an outer surface shaped to be engaged by a tool to be used in rotating the body circumferentially about the axis and sized to present a working outer dimension OD to said tool. The front body portion has a front terminus and an inner surface in which the front terminus is oriented substantially perpendicular to the axis and provides a generally circular receiving aperture communicating with the inner surface. The inner surface is shaped to engage a damaged fastener to be extracted and sized to present a working inner diameter ID to the damaged fastener. The front body portion inner surface has equally spaced, parallel grooves positioned thereon and oriented to extend along an arcuate, inwardly tapering path from a forward groove terminus located proximal to the front body portion front terminus to a rearward groove terminus located proximal to the rear body portion. Each groove has a centerline extending along its length and a pitch P defined by the axial displacement of the centerline per revolution of the centerline about the axis. Each groove further has a substantially constant cross-sectional geometry extending along most of its length, whereby the position of each groove centerline at the forward terminus is $\Theta_1$, $Z_1$ and $R_1$ and the position of each groove centerline at the rearward terminus is $\Theta_2$, $Z_2$ and $R_2$. Due to the inward taper, $R_1$ is greater than ID/2 which is greater than $R_2$, and an angle of inward taper $\mu$ is defined by $\tan \mu=(R_1-R_2)/(Z_1-Z_2)$.

43 Claims, 6 Drawing Sheets

(56) References Cited

U.S. PATENT DOCUMENTS

| | | | | |
|---|---|---|---|---|
| 5,551,320 | A * | 9/1996 | Horobec et al. | 81/53.2 |
| 5,737,981 | A * | 4/1998 | Hildebrand | 81/53.2 |
| 5,904,076 | A * | 5/1999 | Siwy | 81/121.1 |
| 6,003,411 | A | 12/1999 | Knox | |
| 6,047,620 | A * | 4/2000 | Kozak et al. | 81/441 |
| 6,339,976 | B1 * | 1/2002 | Jordan | 81/53.2 |
| 6,536,309 | B1 | 3/2003 | Pool | |
| 6,546,778 | B2 | 4/2003 | Jordan | |
| 6,598,498 | B1 | 7/2003 | Pigford | |
| 6,729,208 | B1 | 5/2004 | Chrzanowski | |
| 6,854,360 | B2 | 2/2005 | Chu | |
| 6,868,756 | B2 | 3/2005 | Kozak | |
| 6,877,402 | B1 * | 4/2005 | Pigford et al. | 81/53.2 |
| 7,152,508 | B2 | 12/2006 | McCalley | |
| 7,152,509 | B2 | 12/2006 | McCalley | |
| 7,185,563 | B2 | 3/2007 | Kozak | |
| D544,322 | S | 6/2007 | Horobec | |
| 7,240,588 | B1 | 7/2007 | Rinner | |
| 7,261,020 | B2 | 8/2007 | Hsieh | |
| 7,594,455 | B2 | 9/2009 | Swanson | |
| 7,661,338 | B2 | 2/2010 | Kochling | |
| 2002/0040625 | A1 | 4/2002 | Jordan | |
| 2003/0056622 | A1 | 3/2003 | Jordan | |
| 2005/0150331 | A1 | 7/2005 | Horobec | |

FOREIGN PATENT DOCUMENTS

| | | | |
|---|---|---|---|
| EP | 851801 | A1 | 7/1998 |
| EP | 930132 | A2 | 7/1999 |
| EP | 1371453 | A2 | 12/2003 |
| EP | 1669164 | A1 | 6/2006 |
| EP | 2196287 | A1 | 6/2010 |
| GB | 2294420 | | 5/1996 |
| GB | 2363748 | | 1/2002 |
| GB | 2366532 | | 3/2002 |
| GB | 2459873 | | 11/2009 |
| WO | 9710926 | | 3/1997 |
| WO | 01/34324 | A1 | 5/2001 |
| WO | 2004/018123 | A1 | 3/2004 |
| WO | 2010033500 | | 3/2010 |

* cited by examiner

DAMAGED FASTENER EXTRACTOR

CROSS REFERENCE TO RELATED APPLICATIONS

This application claims priority to U.S. provisional patent application Ser. No. 61/444,332, filed Feb. 18, 2011.

FIELD OF THE INVENTION

A damaged fastener extractor is disclosed. In a preferred embodiment, the damaged fastener extractor is provided with a body defining generally cylindrical coordinates about an axis and having a rear body portion communicating with a front body portion. The rear body portion has an outer surface shaped to be engaged by a tool to be used in rotating the body circumferentially about the axis and sized to present a working outer dimension OD to said tool. The front body portion has a front terminus and an inner surface in which the front terminus is oriented substantially perpendicular to the axis and provides a generally circular receiving aperture communicating with the inner surface. The inner surface is shaped to engage a damaged fastener to be extracted and sized to present a working inner dimension ID to the damaged fastener. It is understood that ID is the dimension appropriate to an undamaged fastener, and that, depending on the degree of damage to the fastener, the engagement of the damaged fastener would be at a point presenting a slightly smaller dimension than the working inner dimension ID.

The front body portion inner surface has equally spaced, parallel grooves positioned thereon and oriented to extend along an arcuate, inwardly tapering path from a forward groove terminus located proximal to the front body portion front terminus to a rearward groove terminus located proximal to the rear body portion.

In a more preferred embodiment, ID is substantially equal to OD, so that the size of the tool that would fit the damaged fastener if the fastener was not damaged is the same as the size of the tool that would fit the damaged fastener extractor.

In an even more preferred embodiment, a plurality of damaged fastener extractors are provided in a set, and each damaged fastener extractor is sized to correlate with the standard sizes in a set of tools.

BACKGROUND OF THE INVENTION

There is need for a damaged fastener extractor that can provide a combination of features facilitating a convenient selection of a tool to be used to remove a damaged fastener.

The following patents and published applications illustrate the efforts of others to address the problems identified and solved by the disclosure herein. As can be seen, there are a vast array of efforts already existing to provide a solution to the problems confronted when removing damaged fasteners, but none provides the combination of features and advantages presented in the instant disclosure.

These references include U.S. Pat. No. 7,661,338 entitled "Socket Assembly for a Gate Valve Wrench," issued to Kochling on Feb. 16, 2010; U.S. Pat. No. 7,594,455 entitled "Fastener Removing Tool," issued to Swanson et al. on Sep. 29, 2009; U.S. Pat. No. 7,261,020 entitled "Clamping Device for Providing High Twisting Forces and Low Damage to Screw Device," issued to Hsieh on Aug. 28, 2007; U.S. Pat. No. 7,240,588 entitled "Method of Making a Tool for Extracting a Broken Screw," issued to Rinner on Jul. 10, 2007; U.S. Pat. No. 7,185,563 entitled "Impact Driver and Fastener Removal Device," issued to Kozak et al. on Mar. 6, 2007; U.S. Pat. No. 7,152,509 entitled "Fastener Extractor," issued to McCalley, Jr. et al. on Dec. 26, 2006; U.S. Pat. No. 7,152,508 entitled "Ratchet Extraction Wrench," issued to McCalley, Jr. et al. on Dec. 26, 2006; U.S. Pat. No. 6,877,402 entitled "Fastener Extractor," issued to Pigford et al. on Apr. 12, 2005; U.S. Pat. No. 6,868,756 entitled "Device to Extract Broken Fasteners Embedded in a Workpiece," issued to Kozak on Mar. 22, 2005; U.S. Pat. No. 6,854,360 entitled "Socket Tool for Forcibly Detaching Screw Member and a Method for Manufacturing the Socket Tool," issued to Chu on Feb. 15, 2005; U.S. Pat. No. 6,729,208 entitled "Tool for Removing Fasteners," issued to Chrzanowski on May 4, 2004; U.S. Pat. No. 6,598,498 entitled "Fastener Extractor," issued to Pigford et al. on Jul. 29, 2003; U.S. Pat. No. 6,546,778 entitled "Tool for Removing Damaged Fasteners and Method for Making Such Tool," issued to Jordan on Apr. 15, 2003; U.S. Pat. No. 6,536,309 entitled "Bolt and Nut Remover Tool Set," issued to Pool on Mar. 25, 2003; U.S. Pat. No. 6,339,976 entitled "Tool for Removing Damaged Fasteners and Method for Making Such Tool," issued to Jordan on Jan. 22, 2002; U.S. Pat. No. 6,047,620 entitled "Tool for Inserting and Removing One-Way Fasteners, an Off-Center Tool for Inserting and Removing One-Way Fasteners," issued to Kozak et al. on Apr. 11, 2000; U.S. Pat. No. 6,003,411 entitled "Cam-Lobed Salvage Tool," issued to Knox et al. on Dec. 21, 1999; U.S. Pat. No. 5,904,076 entitled "Nut Removal Device," issued to Siwy on May 18, 1999; U.S. Pat. No. 5,737,981 entitled "Removal Device for Threaded Connecting Devices," issued to Hildebrand on Apr. 14, 1998; U.S. Pat. No. 5,551,320 entitled "System for the Removal of Threaded Fasteners," issued to Horobec et al. on Sep. 3, 1996; U.S. Pat. No. 5,361,657 entitled "Drive Socket," issued to Terry on Nov. 8, 1994; U.S. Pat. No. 4,947,712 entitled "Socket Device," issued to Brosnan on Aug. 14, 1990; U.S. Pat. No. 4,057,890 entitled "Method of Removing Broken Threaded Fasteners," issued to Feen on Nov. 15, 1977; U.S. Pat. No. 3,913,427 entitled "Tool for Removing Broken Threaded Fasteners," issued to Brase on Oct. 21, 1975; U.S. Pat. No. 3,161,090 entitled "Stud Engaging Wrench Having a Fluted Gripping Surface," issued to McLellan on Dec. 15, 1964; U.S. Patent Application Publication No. US 2005/0150331 entitled "Removal of Damaged Fasteners," in the name of Horobec, published on Jul. 14, 2005; U.S. Patent Application Publication No. US 2003/0056622 entitled "Tool for Removing Damaged Fasteners and Securing New Fasteners and Improved Method for Making Such Tool," in the name of Jordan, published on Mar. 27, 2003; U.S. Patent Application Publication No. US 2002/0040625 entitled "Tool for Removing Damaged Fasteners and Method for Making Such Tool," in the name of Jordan, published on Apr. 11, 2002; U.S. Design Pat. No. D544,322 entitled "Tapered Helix Socket," issued to Horobec on Jun. 12, 2007; PCT Patent Application No. WO 2004/018123 A1 entitled "Improved Tool for Removing Damaged Fasteners and Securing New Fasteners and Improved Method for Making Such Tool," in the name of Jordan, published on Mar. 4, 2004; PCT Patent Application No. WO 01/34324 A1 entitled "Improved Tool for Removing Damaged Fasteners and Method for Making Such Tool," in the name of Jordan, published on May 17, 2001; Australian Patent No. AU 715,789 entitled "Removal Device for Threaded Connecting Devices," in the name of Hildebrand, issued on Feb. 10, 2000; Australian Patent Application No. AU 2005/242,115 entitled "Ratchet Extraction Wrench," in the name of Smith et al., published on Jun. 22, 2006; European Patent Application No. EP 2,196,287 A1 entitled "Driver with Tapered Hex Socket," in the name of Piper et al., published on Jun. 16, 2010; European Patent Application No. EP 1,669,164 A1 entitled "Ratchet Extraction Wrench for Removing Fasteners that Have Damaged Heads," in the name of Smith et al., published on Jun. 14, 2006; European Patent Application No. EP 1,371,453 A2 entitled "Asymmetric Wrench and Fastener System," in the name of Wright, published on Dec. 17, 2003; European Patent Application No. EP 930,132 A2 entitled "A Tool for Removing One-Way Fasteners," in the name of Kozak et al., published on Jul. 21, 1999; European Patent Application No. EP 851,801 A1 entitled "Removal Device for Threaded Connecting Devices," in the name of Hildebrand, published on Jul. 8, 1998; British Patent Application No. GB 2,459,873 entitled "Tool for Removing Damaged Threaded Fasteners," in the name of Harris, published on Nov. 11, 2009; British Patent Application No. GB 2,366,532 entitled "Tool for Removing Locking Wheel Nuts from Vehicles," in the name of Pillinger, published on Mar. 13, 2002; British Patent Application No. GB 2,363,748 entitled "Socket with First and Second Tapered Threads for Loosening Locknuts," in the name of Suzuki, published on Jan. 9, 2002; British Patent Application No. GB 2,294,420 entitled "Seized Nut Removal Tool," in the name of Sunman, published on May 1, 1996; PCT Patent Application No. WO 2010/033,500 entitled "Adjustable One Way Screw Remover," in the name of Kozak et al., published on Mar. 25, 2010; and PCT Patent Application No. WO 1997/10926 entitled "Removal Device for Threaded Connecting Devices," in the name of Hildebrand, published on Mar. 27, 1997.

U.S. Pat. No. 7,661,338 generally discloses a socket assembly for a gate valve wrench. The socket assembly includes a socket, a support member adapted to mount on the wrench and a fastener for connecting the socket to the support member in such a manner so as to retain the socket fixed in place on the gate valve wrench. The socket includes a cylindrical piece with an inner surface shaped to include twelve inwardly protruding ridges that together define an interior cavity. In use, the socket assembly can be used in conjunction with the wrench to turn a rounded gate valve operating nut. Specifically, with the socket assembly attached to the wrench, the socket is forcibly driven down over the rounded nut such that each ridge digs into the rounded nut. Firmly engaged by the socket, the rounded nut can then be operated using the wrench.

U.S. Pat. No. 7,594,455 generally discloses a fastener removing tool. The fastener removing tool includes an extractor portion having an inside surface adapted to grip a fastener. The extractor portion further defines an outside surface with a cutting edge is adapted to cut a bore when the tool grips and removes a fastener. The fastener removing tool further includes a main body fixed relative to the extractor portion. The main body is adapted to engage with a driving tool for powering rotation of the fastener removing tool. The fastener removing tool also includes a cutter portion fixed relative to the main body opposite the extractor portion. The cutter portion includes a plurality of cutting members defining a plug forming space therebetween. A formed plug is to be placed into the bore formed during extraction of the fastener.

U.S. Pat. No. 7,261,020 generally discloses a clamping device for providing high twisting forces and low damage to a screw device. The device comprises a handle, a driving portion formed with a space, the space including at least two resisting portions and at least two adhesion portions, the resisting portions and adhesion portions being alternatively arranged, each of the connection of the resisting portion and the adhesion portion being formed with a recess for receiving apexes of a screw means so as to prevent the screw means from damage, and each resisting portion having two cambered protrusions at two ends and three sharp teeth between the two cambered protrusions; the apexes of cambered protrusions and sharp teeth being collinear. The driving portion can be used to a sleeve so that sleeve has the same function of the driving portion. It is preferred that there are three resisting portions and three adhesion portions.

U.S. Pat. No. 7,240,588 generally discloses a method of making a tool for removal of broken screws from a base material, including the material of the bone of a medical patient. One end of the tool has an open bore with interior, left-hand tapered screw threads formed thereon by compressing the tool to form the taper after the threads are formed and presented in a cylindrical shape. The other end of the tool is solid for accommodating a driving tool which rotates the tool in the removal of the broken screw.

U.S. Pat. No. 7,185,563 generally discloses a fastener impact driver. The driver includes a fastener engagement member having a plurality of projections disposed about a lower portion that engages a corresponding peripheral portion of a fastener. The device further includes a positioning member having an upper portion that ultimately receives a force thereupon, and a lower portion that engages a cooperating upper portion of the fastener engagement member whereby a force such a hammer strike is imparted upon the upper portion of the positioning member to drive the projections of the fastener engagement member into the head of the fastener without damage of the fastener engagement member, whereupon the positioning member is removed from the fastener engagement member and a hand tool is removably secured to the fastener engagement member to impart rotary motion to the member and the fastener thereby removing the fastener from or urging the fastener into a workpiece.

U.S. Pat. No. 7,152,509 generally discloses a fastener extractor and a method of extracting a fastener. The fastener extractor includes a shaft, an engagement end at a distal end of the shaft and an attachment end at a proximal end of the shaft. The engagement end includes a plurality of helical ridges and grooves. The attachment end extends axially from the shaft and includes a hexagonal cross-sectional portion adapted to engage an extraction tool. Adjacent ones of the plurality of the grooves form the ridges therebetween and the plurality of ridges is adapted to engage a pre-formed opening in a fastener to be removed (FIGS. 1-4; Column 2, Lines 11-15; Claim 1-2).

U.S. Pat. No. 7,152,508 generally discloses a combination ratchet wrench having a standard open-type or box-type wrench at one end thereof and a ratcheting extraction box at the other end. The ratchet extraction wrench box is connected by a ratcheting mechanism to the wrench that allows rotation of the ratchet extraction wrench box relative to the wrench only in one direction. The ratchet extraction wrench box is provided with a fastener extraction head that has an interior bore extending inwardly from a receiving end. The bore has a plurality of helically-shaped grooves, each extending from the receiving end and curve radially and inwardly towards the central axis of the bore to form sharp ridges that extend in a helical fashion inside the bore. When the fastener extraction is placed over a fastener head, the ridges bite into the material of the fastener. Because the extraction head is formed as an integral part of the wrench there is no need to have a separate turning tool. Because a separate torque producing tool is not required and the wrench has a narrow profile, the extraction wrench can be used in tight spaces.

U.S. Pat. No. 6,877,402 generally discloses a fastener extractor that includes an attachment end having an attachment means for connection to an extraction tool and a receiving end. The receiving end has an interior bore that angles inwardly towards the attachment end. The interior bore has a central axis and includes at least two arcuate grooves that extend along the interior bore towards the attachment end. The arcuate grooves curve radially and inwardly toward the central axis of the interior bore, with adjacent arcuate grooves forming sharp helically shaped ridges. A transition area is positioned between the attachment end and the receiving end and has a plurality of arcuate surfaces. Each of the plurality of surfaces corresponds to each of the arcuate grooves and projects inwardly from the corresponding groove towards the central axis. The interior bore is engageable over a fastener to be extracted (FIG. 1; Column 1, Lines 53-57; Claims 1-2).

U.S. Pat. No. 6,868,756 generally discloses a device for extracting broken fasteners. The device has a left-handed cutting tool juxtaposed to a left-handed drill bit surrounded by a socket. The socket has longitudinal slits, a ribbed inner surface, and a threaded outside surface adapted to be received by a collar (FIGS. 1-2; Column 2, Lines 54-63; Claims 1-2).

U.S. Pat. No. 6,854,360 generally discloses a method for manufacturing a socket tool. The method includes: forging a socket blank to form a plurality of arcuate locking grooves; hydraulic working to form a plurality of helical arcuate locking grooves in the socket blank; turning and cutting the periphery of the socket blank to make the periphery of the socket blank smooth; performing a heat treatment on the socket blank; and forming a socket tool having a plurality of helical arcuate locking grooves which are extended and contracted from an outer end to an inner end of the socket tool to form a contracted conical hole. Thus, the socket tool can be used to forcibly rotate and detach a hexagonal screw member having worn or rust corners.

U.S. Pat. No. 6,729,208 generally discloses a tool for removing threaded members, such as fasteners, damaged by corrosion or mechanical stress. The tool includes a first end and a second end opposite the first end. A generally annular body extends between the first and second ends and includes an inner wall. A drive engaging portion is positioned intermediate the first and second ends and is adapted for cooperating with a drive mechanism. A series of spiral flutes is formed along the inner wall of the annular body so as to provide a corresponding series of spiral crests extending along the inner wall. Proceeding from an end of the tool in a direction toward the drive engaging portion, the flutes and crests taper inward toward a central longitudinal axis extending through the annular body. When the tool is placed onto a fastener, the crests bite into an outer surface of the fastener to engage the fastener, thereby facilitating application of torque to the fastener to facilitate its removal (FIGS. 2-3; Column 2, Lines 40-60; Claim 1).

U.S. Pat. No. 6,598,498 generally discloses a fastener extractor that includes an attachment end having an attachment means for connection to an extraction tool and a receiving end. The receiving end has an interior bore that angles inwardly towards the attachment end. The interior bore has a central axis and includes at least two arcuate grooves that extend along the interior bore towards the attachment end. The arcuate grooves curve radially and inwardly towards the central axis of the interior bore, with adjacent arcuate grooves forming sharp helically shaped ridges. A transition area is positioned between the attachment end and the receiving end and has a plurality of arcuate surfaces. Each of the plurality of surfaces corresponds to each of the arcuate grooves and projects inwardly from the corresponding groove towards the central axis. The interior bore is engageable over a fastener to be extracted (FIG. 1; Column 1, Lines 50-64; Claims 1-4).

U.S. Pat. No. 6,546,778 generally discloses a tool for removing damaged fasteners and a method for making such tool. The tool (10) includes a first end (12) and a second end (14) with an outside surface (32) and an inside surface (40) defined between ends (12) and (14). A portion (46) of inside surface (40) is in the shape of an hexagonal frustum (54) that has a major end (58) and that includes spiral splines (25). Splines (25) have constant depth between the major end (58) and the minor end (56) of frustum (54) and the relief angle of splines (25) decreases in the direction from minor end (56) toward major end (58). In the method for making the tool (10), a tubular section (118) is made from a tapered blank (91) by piercing one end of the tapered blank with a pierce punch (132). One end of the tubular section is then driven onto a splined punch (162) to provide splines in one end of the tubular section. The tubular section is then stripped off of the punch (162) by a kick-out sleeve (166) and extruded through a round-to-hexagonal extrusion insert (182) to provide portion (46) of the inner surface (40) with a tapered, hexagonal shape.

U.S. Pat. No. 6,536,309 generally discloses a bolt and stud removal tool and a set thereof. The set includes a body member with a throughbore having a stud engaging end and a shard receiving end. A plurality of uniformly and substantially identical teeth are defined on the inside of the throughbore at the stud engaging end, each tooth defined by converging walls to define a truncated, converging profile.

U.S. Pat. No. 6,339,976 generally discloses a tool for removing damaged fasteners and a method for making such tool. The tool includes a first end and a second end with an outside surface and an inside surface defined between two ends. A portion of the inside surface is shaped as a hexagonal frustum that has a major end and that includes spiral splines. The splines have constant depth between the major end and the minor end of the frustum and the relief angle of the splines decreases in the direction from the minor end toward the major end. To make the tool, a tubular section is made from a tapered blank by piercing one end of the tapered blank with a pierce punch. One end of the tubular section is then driven onto a splined punch to provide splines in one end of the tubular section. The tubular section is then stripped off of the punch by a kick-out sleeve and extruded through a round-to-hexagonal extrusion insert to provide a portion of the inner surface with a tapered, hexagonal shape (FIG. 2; Column 3, Lines 55-65; Claim 1).

U.S. Pat. No. 6,047,620 generally discloses a tool for removing conventional one way fasteners. The tool has a collar and a shank that can be removably received by the collar, wherein in the shank is configured to engage complementary regions of the fastener head. The collar includes a recess having longitudinal ridges to engage perimeter portions of the fastener head. The shank and collar cooperate to provide additional rotational force to the fastener to thereby extract the fastener, whether the fastener is flush-mounted or counter-sunk.

U.S. Pat. No. 6,003,411 generally discloses a salvage tool for removing worn, damaged or seized threaded fasteners. The tool includes a socket body having formed therein a fastener-receiving recess with an axis of rotation, the recess having a plurality of substantially flat planar surfaces arranged in a polygonal configuration and substantially parallel to said axis, with each of said flat planar surfaces having projecting laterally inwardly therefrom a fastener-engaging surface with inner and outer ends spaced apart in use substantially axially, each fastener-engaging surface being arcuate in transverse cross-section perpendicular to said axis and sloping away from said axis from said inner end toward said outer end.

U.S. Pat. No. 5,904,076 generally discloses a device for removing a nut frozen in place, regardless of the degree to which the corners of the nut have been rounded by a prior attempt to remove such nut by an ordinary wrench. The device is formed with an opening, which is sized to receive the nut and formed with a plurality of teeth preferably arranged such that a leading or cutting edge of each tooth engages approximately with a midpoint of a flat of the nut. The front and rear faces of each tooth form an angle of less than 90 degrees. A gullet between the teeth, which is defined by a rear face of one tooth and a front face of a next adjacent tooth, is sized to freely receive the corner(s) between the flats with which the leading edges of an adjacent pair of teeth engage. The gullet is shaped and sized to permit the formation of a chip upon penetration of a leading edge into a flat of a nut, which is operable to lock the nut for rotation with the device.

U.S. Pat. No. 5,737,981 generally discloses a removal device for removing difficult to remove threaded connecting devices threaded in a first direction. The device includes a body having a first end and a second end. The first end includes an opening extending toward the second end. The opening is sized to receive a threaded connecting device threaded in a first direction and continuously tapers from a first diameter at the first end to a second diameter at the second end. The opening further includes an internal surface that is threaded in direction opposite to the threading of the threaded connecting device to be removed.

U.S. Pat. No. 5,551,320 generally discloses a device for removing threaded fasteners with rounded off heads. The device has a socket head having a partly cylindrical external configuration with an upper end and a lower end and an axis with a first axial length therebetween. A surface on the upper end is adapted to receive the end of a turning tool externally and internally. The lower end of the socket head is fabricated with a major recess of a generally frustroconical configuration with a second axial length. The major recess has an interior surface formed with a plurality of V-shaped projections integral with the socket and extending radially inwardly from the lower end with V-shaped valleys intermediate the V-shaped projections, thereby forming a plurality of triangles with radially interior teeth. Each of the triangles has an apex with two faces of essentially common lengths. The faces of each triangle are offset essentially equally from the radius of the cylinder. The apex of each tooth is angularly oriented with respect to the axis of the cylinder. The axial interior of the major recess has a smaller diameter than the axial exterior of the major recess whereby when placed over the threaded fastener and when the socket head is rotated with a ratchet motion, the teeth will pull downwardly over the threaded fastener and bite into its exterior surface to effect a coupling therebetween for rotation of the socket head and associated threaded fastener to effect its removal.

U.S. Pat. No. 5,361,657 generally discloses a drive socket for imparting torque loads to a fastener element includes a body with a cavity opening to a distal end for receiving the fastener element. The cavity has protuberances projecting inwardly toward the central axis from the cavity surface to engage the fastener element. The protuberances have a frustopyramidal shape and are uniformly spaced circumferentially around and longitudinally along the cavity surface. The protuberances thus form a cross-hatched or knurled pattern. The cavity is tapered to further assist in fastener engagement. The protuberances firmly engage the fastener element at longitudinally intermittent points to apply torque loads and facilitate rotary displacement.

U.S. Pat. No. 4,947,712 generally discloses a wrench-type socket for removing bolts and the like whose head has become damaged or otherwise worn, thus prohibiting its removal by the use of a conventional socket. The present socket has an internal central cavity which is formed with at least one, but preferably a plurality, of elongated projections or shoulders which extend into said cavity, and which upon rotating the socket are intended to partially penetrate into the damaged bolt head and thus provide a driving connection therebetween to thereby provide torque to said bolt to thus cause its removal. If desired, the user may strike the means for rotating the socket to embed the projections or shoulders into the bolt head.

U.S. Pat. No. 4,057,890 generally discloses a method for removing broken fasteners so the broken shank is readily removable after a shear-type fracture of the fastener shank. In one embodiment, the fastener is a hex head machine bolt with uniformly spaced slots cut into the shank from one end to the other, and filled with a lubricant material prior to installation. After a shear-type fracture, a tool with axial projections at one end mating with the slots is inserted into the spaces formed by the slots in the periphery of the sheared-off shank portion. This forces lubricant into the threads and provides reaction surfaces so the tool can be used to turn the shank portion out of the tapped hole. In another application, an Allen head stud can be similarly slotted (FIGS. 1-4; Column 2, Lines 6-25; Claim 1).

U.S. Pat. No. 3,913,427 generally discloses a tool for removing broken threaded fasteners or studs. The tool has an open-ended gripping member with an interior wall formed by longitudinal, spaced apart ridge portions adapted to form gripping grooves when driven axially onto a broken threaded fastener. The gripping member is fixed to one end of a threaded shaft that extends through the end wall of a sleeve and is attached at its other end to a flat sided head member. A movable nut is threaded to the shaft between the sleeve and the head member for removing the gripping member from the broken fastener after it has been loosened (FIG. 3; Column 1, Lines 24-29; Claim 1).

U.S. Pat. No. 3,161,090 generally discloses a hexagonally cross-sectioned stud engaging wrench. A fluted gripping surface is provided internally within a bore that provides helical flutes of high pitch. Blade portions are provided within the bore having concave side faces defined by the curvilinear flutes and tapering to relatively sharp blade edges at their intersections which extend helically within the bore.

U.S. Patent Application No. 2005/0150331 generally discloses a device for removing damaged fasteners. The device provides a socket head with a partly cylindrical external configuration. The upper end receives the end of a turning tool. The major recess has an interior surface formed with a plurality of inverted L-shaped frustroconical projections. The teeth can be altered to create more torque. The angle of each tooth is between 98 and 105 degrees, with a recess at the bottom of each leg. Each tooth has two faces of uncommon lengths. The apex of each tooth is angularly oriented with respect to the axis of the cylinder. The axial interior of the major recess has a smaller diameter than the axial exterior of the major recess whereby when the socket head is rotated with a ratchet motion, the teeth will pull downwardly over the damaged fastener and bite into its exterior surface of the fastener to effect its removal (FIG. 3; Paragraph [0002]; Claim 6).

U.S. Patent Application No. 2003/0056622 generally discloses a tool for removing damaged fasteners and a method for making such tool. The tool includes a first end and a second end with an outside surface and an inside surface defined between the ends. A portion of the inside surface is shaped as a hexagonal frustum that has a major end and includes spiral splines. The splines have constant depth between the major end and the minor end of a frustum. The relief angle of the splines increases in the direction from minor end toward major end. To make the tool, a tubular section is made from a tapered blank by piercing one end of the tapered blank with a pierce punch. One end of the tubular section is then driven onto a splined punch to provide a splined tubular section having splines in one end. The splined tubular section is then stripped off of the punch by a kick-out sleeve and extruded through a round-to-hexagonal extrusion insert to provide a splined polygonal section having an inner surface with a tapered, hexagonal shape. A modified round-to-hexagonal extrusion insert provides a tool with corners on the polygonal surface. A modified tool with splines in a clockwise spiral is used to secure tamper-resistant fasteners. The modified tool is made by substituting a clockwise splined punch in the tool-making method (FIG. 2; Paragraph [0017]; Claim 12).

U.S. Patent Application Publication No. US 2002/0040625 discloses a tool for removing damaged fasteners and a method for making such tool. The tool (10) includes a first end (12) and a second end (14) with an outside surface (32) and an inside surface (40) defined between ends (12) and (14). A portion (46) of inside surface (40) is in the shape of an hexagonal frustum (54) that has a major end (58) and that includes spiral splines (25). Splines (25) have constant depth between the major end (58) and the minor end (56) of frustum (54) and the relief angle of splines (25) decreases in the direction from minor end (56) toward major end (58). In the method for making the tool (10), a tubular section (118) is made from a tapered blank (91) by piercing one end of the tapered blank with a pierce punch (132). One end of the tubular section is then driven onto a splined punch (162) to provide splines in one end of the tubular section. The tubular section is then stripped off of the punch (162) by a kick-out sleeve (166) and extruded through a round-to-hexagonal extrusion insert (182) to provide portion (46) of the inner surface (40) with a tapered, hexagonal shape.

U.S. Design Pat. No. D544,322 illustrates a tapered helix socket. As illustrated, the socket provides a helix socket having a base containing an inner, socket drive-receiving aperture and an outer, wrench receiving outer contour. Angled protrusions appear on the socket side of the tool, ostensibly to bite into or around a damaged fastener to be extracted (FIG. 9).

PCT Patent Application No. WO 2004/018123 A1 discloses a tool for removing damaged fasteners and a method for making such tool. A portion (46) of inside surface (40) of tool (10) is in the shape of a hexagonal frustum (54) that includes spiral splines (25). Splines (25) have constant depth between the major end (58) and the minor end (56) of frustum (54) and the relief angle (GBP) of splines (25) increases in the direction from minor end (56) toward major end (58). In the method for making the tool (10), a tubular section (118) is made from a tapered blank (91) by piercing one end of the tapered blank with a pierce punch (132). The tubular section is then driven onto a splined punch (162) to provide a splined tubular section (165) having splines in one end. The splined tubular section is then extruded through a round-to-hexagonal extrusion insert (182) to provide a splined polygonal section (173) having an inner surface with a tapered, hexagonal shape. A modified round-to-hexagonal extrusion insert (206) provides a tool with corners (202) on the polygonal surface. A modified tool (310) with splines (325) in a clockwise spiral is used to secure tamper-resistant fasteners.

PCT Patent Application No. WO 01/34324 A1 discloses a tool for removing damaged fasteners and a method for making such tool wherein the tool (10) includes a first end (12) and a second end (14) with an outside surface (32) and an inside surface (40) defined between ends (12) and (14). A portion (46) of inside surface (40) is in the shape of a hexagonal frustum (54) that has a major end (58) and that includes spiral splines (25). Splines (25) have constant depth between the major end (58) and the minor end (56) of frustum (54) and the relief angle of splines (25) decreases in the direction from minor end (56) toward major end (58). In the method for making the tool (10), a tubular section (118) is made from a tapered blank (91) by piercing one end of the tapered blank with a pierce punch (132). One end of the tubular section is then driven onto a splined punch (162) to provide splines in one end of the tubular section. The tubular section is then stripped off of the punch (162) by a kickout sleeve (166) and extruded through a round-to-hexagonal extrusion insert (182) to provide portion (46) of the inner surface (40) with a tapered, hexagonal shape.

Australian Patent No. AU 715,789 discloses a removal device (10) for removing difficult to remove threaded connecting devices threaded in a first direction. The device (10) includes a body (12) having a first end (14) and a second end (16), wherein the first end includes an opening (20), which extends toward the second end (16), sized to receive a threaded connecting device and continuously tapers from a first diameter (24) at the first end (14) to a second diameter (26) at the second end (16), wherein the first diameter (24) is larger than the second diameter (26). The opening further includes an internal surface (22) threaded in a direction opposite the first direction. The device (10) further includes structure for rotating the body (12), such rotation causing the internal threading of the removal device (10) to engage the threaded connecting device causing the threaded connecting device to rotate in a direction appropriate for the removal of the threaded connecting device threaded in the first direction.

Australian Patent Application No. AU 2005/242,115 generally discloses a combination ratchet wrench having a standard open-type or box-type wrench at one end and a ratcheting extraction box at the other end. The box is connected to the wrench by a ratcheting mechanism to allow rotation of the ratchet extraction wrench box relative to the wrench only in one direction. A fastener extraction head having an interior bore extending inwardly from a receiving end is provided to the box. The bore has helically shaped grooves that extend from the receiving end and curve radially and inwardly toward the central axis of the bore to form sharp ridges that extend in a helical fashion inside the bore.

European Patent Application No. EP 2,196,287 A1 discloses a driver used to manually drive a fastening member. The driver includes a shank, a handle provided at an end thereof, and a socket provided at the opposite end thereof. The socket has a receptacle which includes a front portion extending from a front face of the socket a predetermined distance and a tapered portion extending from the front portion a predetermined distance. The front portion is larger than the outer dimension of the fastening member and is formed from walls which are parallel to the centerline of the socket. The tapered portion tapers inwardly from the front portion toward the centerline. The tapered portion extends uninterrupted 360 DEG around the receptacle such that a rear edge of the fastening member continuously contacts the tapered portion when inserted therein.

European Patent Application No. EP 1,669,164 A1 discloses a combination ratchet wrench (2) having a standard open-type or box-type wrench (8) at one end thereof and a ratcheting extraction box (16) at the other end thereof. The ratchet extraction wrench box (16) is connected by a ratcheting mechanism to the wrench (2) that allows rotation of the ratchet extraction wrench box (16) relative to the wrench (2) only in one direction. The ratchet extraction wrench box (16)

is provided with a fastener extraction head (40) that has an interior bore (58) extending inwardly from a receiving end (56). The bore (58) has a plurality of helically-shaped grooves (60), each extending from the receiving end (56) and curve radially and inwardly towards the central axis of the bore (58) to form sharp ridges (62) that extend in a helical fashion inside the bore (58). When the fastener extraction (2) is placed over a fastener head, the ridges (62) "bite" into the material of the fastener. Because the extraction head (40) is formed as an integral part of the wrench (2) there is no need to have a separate turning tool. Because a separate torque producing tool is not required and the wrench (2) has a narrow profile, the extraction wrench (2) can be used in tight spaces.

European Patent Application No. EP 1,371,453 A2 discloses an asymmetrical wrench and fastener system. The system comprises radially extending splines having opposing surfaces whose inner ends are inclined by different amounts with respect to a radius intersecting the respective inner ends to alter the torque between the tightening and loosening directions. This configuration makes it either easier or harder to loosen the fastener than it was to tighten it, depending on the amount the opposing surfaces of the splines are inclined.

European Patent Application No. EP 930,132 A2 discloses a tool for removing conventional one-way fasteners. The tool comprises a collar (22) and a shank (20) that can be removably received by the collar (22), wherein the shank (20) is configured to engage complementary regions of the fastener head (13). The collar (22) includes a recess (48) having longitudinal ridges (68) to engage perimeter portions of the fastener head (13). The shank (20) and collar (22) cooperate to provide additional rotational force to the fastener (12) to thereby extract the fastener, whether the fastener (12) is flush-mounted or counter-sunk.

European Patent Application No. EP 851,801 A1 generally discloses a removal device for removing difficult to remove threaded connecting devices threaded in a first direction. The device includes a body having a first end and a second end. The first end includes an opening extending toward the second end. The opening is sized to receive a threaded connecting device threaded in a first direction and continuously tapers from a first diameter at the first end to a second diameter at the second end. The opening further includes an internal surface that is threaded in direction opposite to the threading of the threaded connecting device to be removed.

British Patent Application No. GB 2,459,873 discloses a hand tool for removing threaded fixings with a damaged head. The tool has a cylindrical body 1 with an aperture having internal sharp splines 2 which cut into the threaded fixing to secure the body to the fixing. This is effected by attaching a male square drive member 6 of a striking plate 4 into a corresponding square drive recess 3 in the cylindrical body 1, and hitting a striking face 5 of the striking plate 4 with a hammer. A user can then remove the threaded fixing with a damaged head 7 by removing the striking plate 4 and attaching a square drive turning tool to the recess 3 in the cylindrical body 1.

British Patent Application No. GB 2,366,532 discloses a tool for removing locking wheel nuts or bolts from vehicles. For example when the original key/socket has been lost, the tool provides teeth that can be located over the nut to form a tight fit. This tight fit may be achieved with the aid of a drift (see FIG. 2) and a conventional hammer. A conventional lever bar or air wrench may then be used to undo the nut. Once the nut has been removed, the nut may be extracted from the teeth of the tool using a threaded T-bar (see FIG. 3) which engages with a thread provided on the tool.

British Patent Application No. GB 2,363,748 discloses a socket for loosening locknuts. The tool comprises a cylindrical body 1, and a border portion formed at an intermediate part of the body. A first tapered thread 2 extends from the border portion towards one end of the body, and a second tapered thread 3 extends from the border portion towards the other end of the body, where the second tapered end is dimensioned differently from the first tapered thread. Preferably the first and second threads are left-handed threads.

British Patent Application No. GB 2,294,420 discloses a tool for removing damaged fasteners, e.g. nuts. The tool has an internal helical cutting thread 6 in a tapering bore, which enables seized or damaged fasteners (iii) to be removed, normally without damage to the stud iv upon which the fastener is mounted. A drive bar (ii) is inserted into a square section cavity (a) of the tool and the assembly is then rotated, causing the cutting thread 6 to bite into the fastener (iii) thus facilitating its removal.

PCT Patent Application No. WO 2010/033,500 discloses a tool for removing conventional one way fasteners. The tool includes, generally, a member, a collar, and, a shaft that can be removably received by the collar, wherein in the shaft is configured to engage regions of the fastener head. The collar is adjustable to fit fastener head of different sizes. The member can be configured to correspond to a threaded portion of the outer surface of the collar. The collar may also have a bottom portion that includes multiple splines.

PCT Patent Application No. WO 1997/10926 generally discloses a removal device for removing difficult to remove threaded connecting devices threaded in a first direction. The device includes a body having a first end and a second end. The first end includes an opening extending toward the second end. The opening is sized to receive a threaded connecting device threaded in a first direction and continuously tapers from a first diameter at the first end to a second diameter at the second end. The opening further includes an internal surface that is threaded in direction opposite to the threading of the threaded connecting device to be removed.

Thus, a problem associated with devices that precede the present disclosure is that they do not provide, in combination with the other features and advantages disclosed herein, a geometry of the damaged fastener engagement aperture to facilitate convenient selection of the appropriate tool to be used to turn the damaged fastener extractor.

Yet another problem associated with devices that precede the present disclosure is that they do not provide, in combination with the other features and advantages disclosed herein, the optimal disposition and positioning of engagement grooves to effectuate relatively uniform engagement of all corners of a damaged fastener to be extracted.

Still a further problem associated with devices that precede the present disclosure is that they do not provide, in combination with the other features and advantages disclosed herein, a selectable geometry of engagement grooves to optimize the ability to transfer force from a tool through the damaged fastener extractor to the damaged fastener to be extracted.

An additional problem associated with devices that precede the present disclosure is that they do not provide, in combination with the other features and advantages disclosed herein, a selectable geometry of grooves to optimize longevity of the damaged fastener extractor.

Another problem associated with devices that precede the present disclosure is that they do not provide, in combination with the other features and advantages disclosed herein, a selectable angle of inward taper to the engagement grooves to permit ease of use with different shaped damaged fasteners.

An even further problem associated with devices that precede the present disclosure is that they do not provide, in combination with the other features and advantages disclosed herein, a selectable angle of axial orientation of the engagement grooves to permit optimal force transfer from a tool through the damaged fastener extractor to the damaged fastener to be extracted.

There is a demand, therefore, to overcome the foregoing problems while at the same time providing a damaged fastener extractor that is relatively low in cost to manufacture and yet possesses extended durability.

SUMMARY OF THE INVENTION

In a preferred embodiment, a damaged fastener extractor is provided with a body defining generally cylindrical coordinates $\Theta$, Z and R about an axis and having a rear body portion communicating with a front body portion. The rear body portion has an outer surface shaped to be engaged by a tool to be used in rotating the body circumferentially about the axis and sized to present a working outer dimension OD to said tool. The front body portion has a front terminus and an inner surface in which the front terminus is oriented substantially perpendicular to the axis and provides a generally circular receiving aperture communicating with the inner surface.

The inner surface is shaped to engage a damaged fastener to be extracted and sized to present a working inner dimension ID to the damaged fastener. It is understood that ID is the dimension appropriate to an undamaged fastener, and that, depending on the degree of damage to the fastener, the engagement of the damaged fastener may be at a point presenting a slightly smaller dimension than the working inner dimension ID.

The front body portion inner surface has equally spaced, parallel grooves positioned thereon and oriented to extend along an arcuate, inwardly tapering path from a forward groove terminus located proximal to the front body portion front terminus to a rearward groove terminus located proximal to the rear body portion. Each groove has a centerline extending along its length and a pitch P defined by the axial displacement of the centerline per revolution of the centerline about the axis. Each groove further has a substantially constant cross-sectional geometry extending along most of its length, whereby the position of each groove centerline at the forward terminus is $\Theta_1$, $Z_1$ and $R_1$ and the position of each groove centerline at the rearward terminus is $\Theta_2$, $Z_2$ and $R_2$. For clarity, it is understood that the value of Z increases from $Z_1$ to $Z_2$.

The grooves are positioned so that at their outer edges, they intersect an outer edge of an adjacent groove, thereby defining ridges configured to engage a damaged fastener to be removed. As thus configured, when the extractor is positioned over the damaged fastener to be removed and is rotated, the ridges engage the damaged fastener. As additional torque is applied to the damaged fastener extractor, the ridges begin to (a) cut or bite into the damaged fastener to be removed and (b) transfer torque to the damaged fastener. When the torque thus transferred from the extractor to the damaged fastener is equal to the torque necessary to remove the damaged fastener, the damaged fastener begins to turn and can thereby be extracted.

Due to the inward taper, $R_1$ is greater than ID/2 which is greater than $R_2$, and an angle of inward taper $\mu$ is defined by $\tan \mu=(R_1-R_2)/(Z_1-Z_2)$.

In a more preferred embodiment, ID is substantially equal to OD. This is particularly helpful when the fastener is a bolt or other tool that is usually engaged by a wrench, so that the size of the wrench that would fit the damaged fastener if the fastener was not damaged is the same as the size of the wrench that would fit the damaged fastener extractor.

In an even more preferred embodiment, a plurality of damaged fastener extractors comprise a set, each damaged fastener extractor being sized to correlate with the standard sizes in a set of tools.

Thus, it is an object of the present disclosure to provide, in combination with the other features and advantages disclosed herein, a geometry of the damaged fastener engagement aperture to facilitate convenient selection of the appropriate tool to be used to turn the damaged fastener extractor.

Yet another object of the present disclosure is to provide, in combination with the other features and advantages disclosed herein, an optimal disposition and positioning of engagement grooves to effectuate relatively uniform engagement of all corners of a damaged fastener to be extracted.

Still a further object of the present disclosure is to provide, in combination with the other features and advantages disclosed herein, a selectable geometry of engagement grooves to optimize the ability to transfer force from a tool through the damaged fastener extractor to the damaged fastener to be extracted.

An additional object of the present disclosure is to provide, in combination with the other features and advantages disclosed herein, a selectable geometry of grooves to optimize longevity of the damaged fastener extractor.

Another object of the present disclosure is to provide, in combination with the other features and advantages disclosed herein, a selectable angle of inward taper to the engagement grooves to permit ease of use with different shaped damaged fasteners.

An even further object of the present disclosure is to provide, in combination with the other features and advantages disclosed herein, a selectable pitch P defined by the axial displacement of the centerline per revolution of the centerline about the axis to permit optimal force transfer from a tool through the damaged fastener extractor to the damaged fastener to be extracted.

The following disclosure provides a damaged fastener extractor that provides the foregoing advantages while at the same time is relatively low in cost to manufacture and possesses extended durability.

BRIEF DESCRIPTION OF THE DRAWINGS

In the detailed description that follows, reference will be made to the following figures.

DETAILED DESCRIPTION OF PREFERRED EMBODIMENTS

Figure 1:
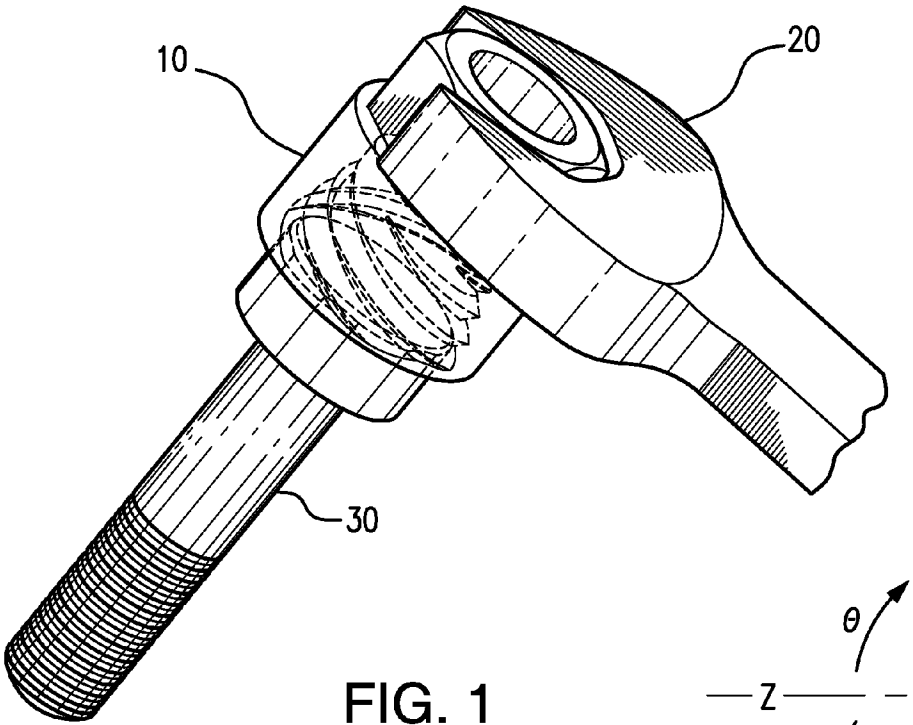
FIG. 1 is a perspective view of a preferred embodiment in position for use with a damaged fastener.

As shown in FIG. 1 a damaged fastener extractor 10 is provided for use with a tool 20 to remove a damaged fastener 30. The tool 20, which as shown is an open end wrench, is fitted over the damaged fastener extractor 10 and transmits torque through the extractor 10 to the damaged fastener 30, thereby effecting its removal.

Figure 2:
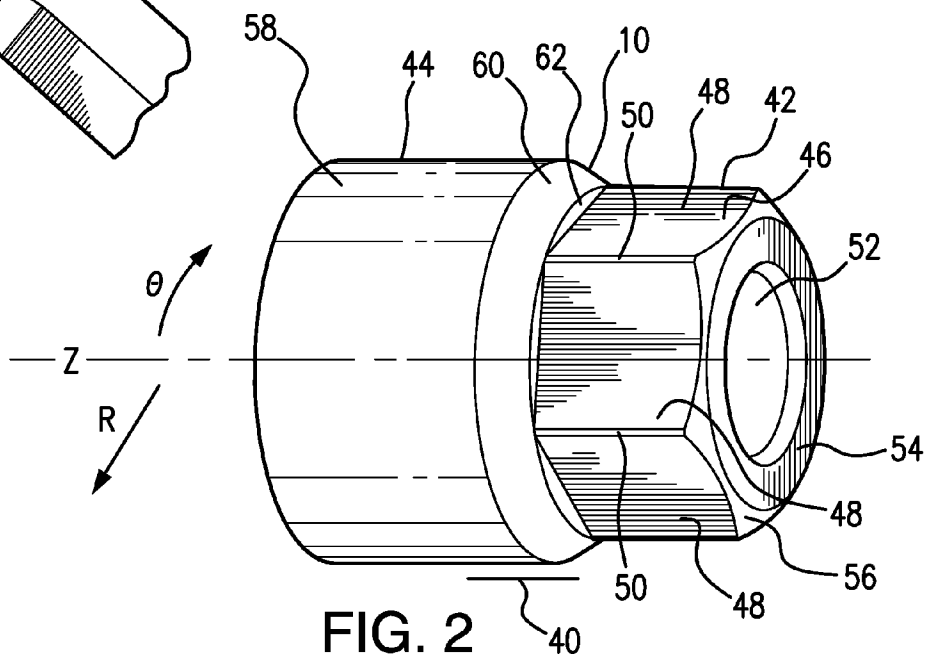
FIG. 2 is a perspective view of the preferred embodiment illustrated in FIG. 1.

As shown in FIG. 2, the extractor 10 has a body 40 defining generally cylindrical coordinates $\Theta$, Z and R about an axis and having a rear body portion 42 communicating with a front body portion 44. The rear body portion 42 has an outer surface 46 shaped to be engaged by the tool 20 to be used to rotate the body 40 circumferentially about the axis.

Figure 5:
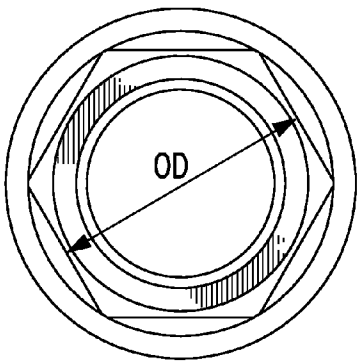
FIG. 5 is a bottom plan view of the preferred embodiment illustrated in FIG. 3.

The rear body portion outer surface 46 is shaped hexagonally and has six sides 48. The sides 48 are spaced apart to present a working outer dimension OD to the tool 20 (see FIG. 5). The sides 48 have axial bevel regions 50 therebetween for durability and to reduce the sharpness of the extractor 10 to the user.

The rear body portion 42 is further provided with a rear centerhole 52 having a reinforcement ridge 54 disposed centrally therearound. A centerhole bevel region 56 extends from the reinforcement ridge 54 to the hexagonal sides 48 of the outer surface 46.

The front body portion 44 is mounted to the rear body portion 42 and has a generally cylindrical outer surface 58 with a rearward bevel 60 extending therefrom to a flattened rear surface 62 in communication with the rear body portion 42.

Figure 3:
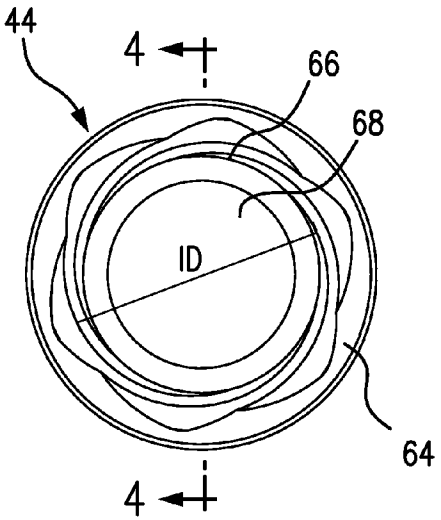
FIG. 3 is a top plan view of a second preferred embodiment.
Figure 6:
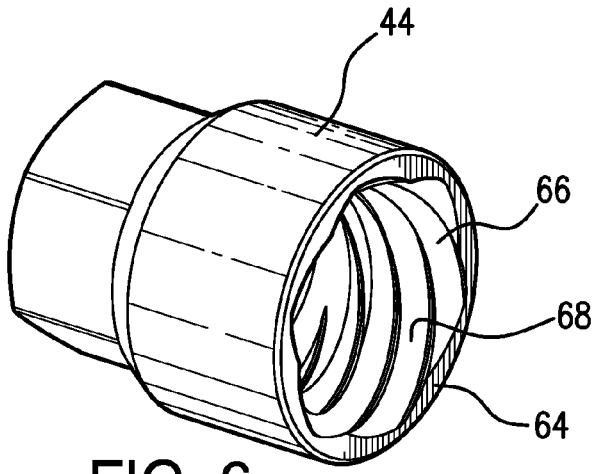
FIG. 6 is a perspective view of the preferred embodiment illustrated in FIG. 3.

Referring now to FIGS. 3 and 6, the front body portion 44 has a front terminus 64 and an inner surface 66. The front terminus 64 is oriented substantially perpendicular to the axis and provides a generally circular receiving aperture 68 communicating with the inner surface 66. The inner surface 66 is shaped to engage a damaged fastener 30 to be extracted and is further sized to present a working inner dimension ID to the damaged fastener 30. It is understood that ID is the dimension appropriate to an undamaged fastener, and that, depending on the degree of damage to the fastener, the engagement of the damaged fastener would be at a point presenting a slightly smaller dimension than the working inner dimension ID. As shown in FIGS. 12(*a*) through 12(*d*), fasteners with which the extractor can be used generally present an outer dimension S. For multifaceted fastener heads, such as bolts shown in FIGS. 12(*a*) (hexagonal) and 12(*b*) (pentagonal), this dimension is the same as the inscribed circle diameter taken along the dotted line inside, but adjacent to, each of the bolt faces. For round fastener heads, such as Allen screws (FIG. 12(*c*)) or Phillips head screws (FIG. 12(*d*)), the outer dimension S is the same as the actual diameter of the head. Thus, a damaged fastener extractor is selected so that ID=S.

Figure 7:
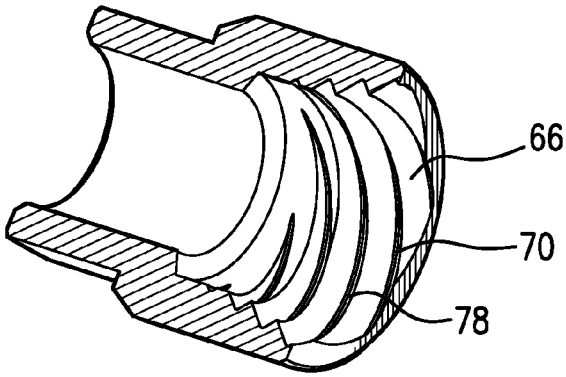
FIG. 7 is a cut-away view of the preferred embodiment illustrated in FIG. 6.
Figure 8:
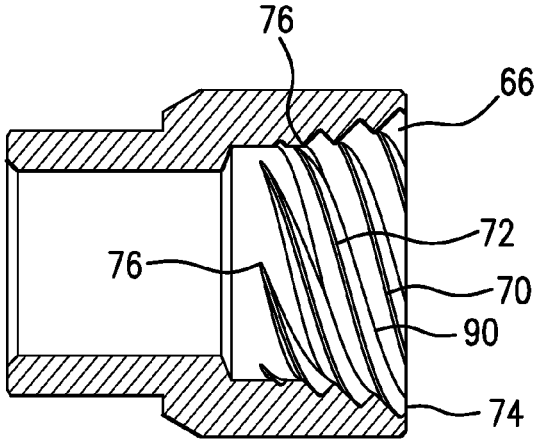
FIG. 8 is a cross-sectional view of the preferred embodiment illustrated in FIG. 6.

Referring now to FIGS. 7 and 8, the front body portion inner surface 66 further has a plurality of equally spaced, parallel grooves 70 positioned thereon and oriented to extend along an arcuate, inwardly tapering path 72 from a forward groove terminus 74 located proximal to the front body portion front terminus 64 to a rearward groove terminus 76 located proximal to the rear body portion 42. By denoting that there are N such grooves 70, that they are parallel and equally spaced, and that they are adjacent to one another, it can be seen that these are disposed about the circumference of the receiving aperture and separated from one another along angles of N/360 degrees.

Figure 4:
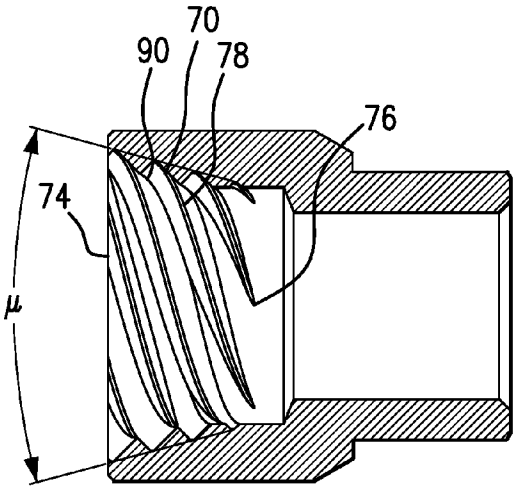
FIG. 4 is a cut-away view of the preferred embodiment illustrated in FIG. 3 taken along the line 4-4 in FIG. 3.

As shown in FIG. 4, each groove 70 has a centerline 78 extending along its length. It is understood that the pitch P of the groove 70 is given in units of distance per revolution, e.g. the distance the groove centerline 78 travels in the axial (Z) direction per revolution or 360 degrees $\Theta$. It may be convenient to express a dimensionless pitch, e.g. by dividing the pitch as given above by ID, so that P/ID expresses the pitch in a dimensionless fashion. In this fashion, different sized extractors 10 can be readily seen to have identical geometries.

Each groove 70 further has a substantially constant cross-sectional geometry extending along most of its length, whereby the position of each groove centerline 78 at the forward terminus 74 is $\Theta_1$, $Z_1$ and $R_1$ and the position of each groove centerline at the rearward terminus 76 is $\Theta_2$, $Z_2$ and $R_2$. By this nomenclature, it is seen that $R_1$ is greater than ID/2 which is, in turn, greater than $R_2$. An angle of inward taper $\mu$ is defined by $\tan \mu=(R_1-R_2)/(Z_1-Z_2)$. Preferably, $R_1$ is between about 105% and 110% of ID/2 and, most preferably, $R_1$ is about 108% of ID/2.

In a most preferred embodiment, ID is equal to OD, so that the size of the tool 20 that would have fit the damaged fastener 30 had the fastener not been damaged is the same as the size of the tool that will fit the damaged fastener extractor 10.

Additionally, the number of grooves 70 to be provided will ideally match the number of sides on the damaged fastener. This can be 12, as shown in FIG. 1, or 6, as shown in FIGS. 3 through 9, or any other number commonly associated with fasteners that may become damaged and therefore would benefit from application of an extractor as disclosed herein.

In contrast with devices that provide one or more threads to effect removal of damaged fasteners, the instant disclosure provides grooves 70. These do not extend around the inner surface 66 more than once in revolution; instead, each groove 70 extends along an arc of $\Theta_2-\Theta_1 \leq 360$ degrees. In a more preferred embodiment, each groove 70 extends along an arc of $\Theta_2-\Theta_1 \leq 210$ degrees.

As shown in FIG. 11, the grooves 70 each further have a pair of substantially planar groove walls 82 oriented with respect to one another to form a substantially constant angle $\alpha$ of intersection extending along most of the length of each groove 70, thereby defining the substantially constant cross-sectional geometry extending along most of the length of each groove. The angle $\alpha$ is preferably selected to be between about 60 degrees and 120 degrees and, in a more preferred embodiment, is selected to be about 90 degrees.

Figure 10:
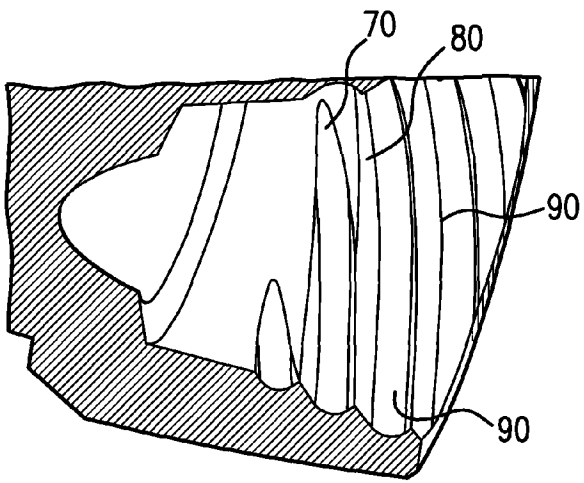
FIG. 10 is a cut-away view of a fourth preferred embodiment.
Figure 9:
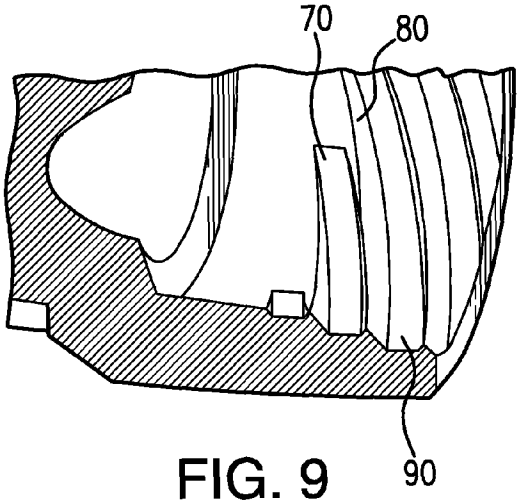
FIG. 9 is a cut-away view of a third preferred embodiment.
Figure 11D:
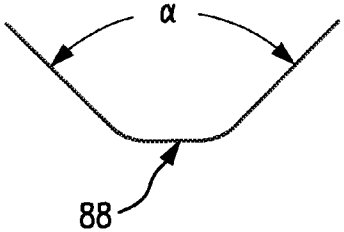
FIGS. 11(*a*) through 11(*d*) are schematic representations of different contours associated with the respective grooves of the various preferred embodiments.
Figure 11C:
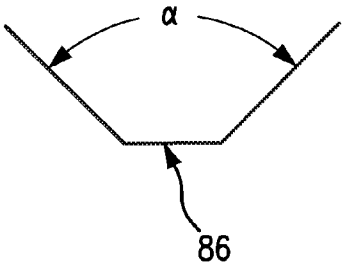
Figure 11B:
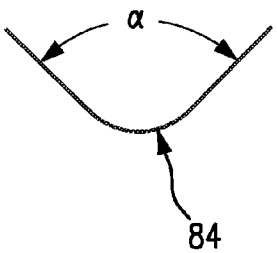
Figure 11A:
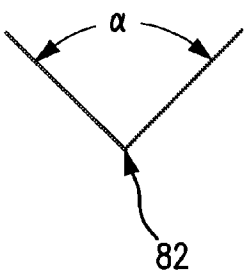
Figure 12A:
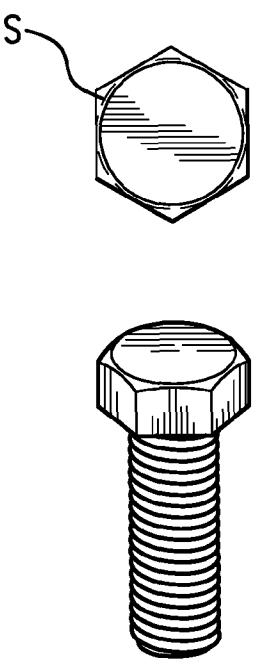
FIGS. 12(*a*) through 12(*d*) are illustrations of different fasteners with which the preferred embodiment can be used.
Figure 12B:
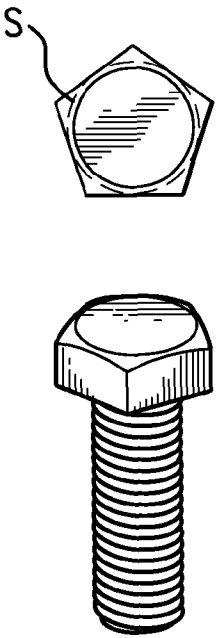
Figure 12C:
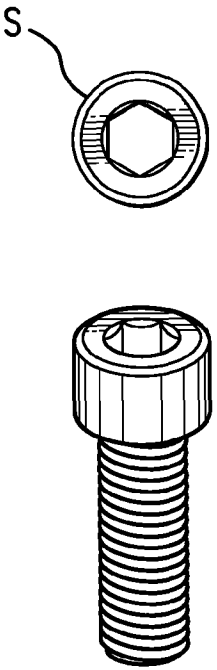
Figure 12D:
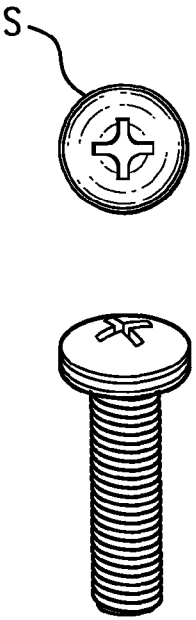

As shown in FIGS. 11(*a*) through 11(*d*), the cross-sectional geometry of each groove 70 is generally V-shaped. Variations in the geometry are illustrated to provide each groove bottom with varying geometries, e.g. a sharp corner 82 (FIG. 11(*a*)), a rounded bottom 84 (FIG. 11(*b*)), a flat bottom with sharp corners 86 (FIG. 11(*c*)) or a flat bottom with rounded corners 88 (FIG. 11(*d*)). In yet another configuration, as shown in FIGS. 9 and 10, the grooves 70 each further comprise a pair of substantially planar groove walls 80 spaced apart with respect to one another to form a substantially trapezoidal cross-sectional geometry extending along most of the length of each groove. Other configurations can be applied to optimize the performance of the extractor 10. Note that in each of these configuration, an angle α represents the angle of intersection of the groove walls 80.

Another geometric relationship shown in the preferred embodiments disclosed herein is the ratio of $Z_1-Z_2$ to ID; this gives the general shape of the tool, e.g., shallow, medium or deep. In a more preferred embodiment, $Z_1-Z_2$, is between about 50% and 150% of ID. In a yet more preferred embodiment, $Z_1-Z_2$, is between about 80% and 130% of ID. In a still more preferred embodiment, $Z_1-Z_2$, is about 125% of ID.

The grooves 70 are positioned so that at their outer extremes, they intersect an adjacent groove to define ridges 90 (shown in FIGS. 4, 8, 9 and 10) configured to engage a damaged fastener 30. In a preferred embodiment, the ridges 90 are sharp, not rounded. The ridges 90 therefore intersect at an angle equal to the angle α representing the angle of intersection of the groove walls 80. The ridges 90 define a path substantially parallel to the path of the groove centerline 78.

Additional geometric relationships are observed in the preferred embodiments disclosed herein. For example, in a preferred embodiment, as explained above, because the grooves 70 preferably each intersect an adjacent groove 70 to define ridges 90, a width W of the groove 70 is generally defined as $(P/N)/(\cos(\mu/2))$.

Other selections can be made to the design parameters of the grooves 70 to affect the performance of the extractor 10. For example, the pitch P is preferably selected to be between about 50% of ID and 150% of ID. In a more preferred embodiment, the pitch P is between about 90% of ID and 110% of ID. In a most preferred embodiment, the pitch P is about equal to ID.

Likewise, the angle of inward taper μ is preferably selected to be between about 10 degrees and about 50 degrees. In a more preferred embodiment, the angle of inward taper μ is between about 20 degrees and 30 degrees. In a most preferred embodiment, the angle of inward taper μ is about 26 degrees.

Selecting the appropriate pitch, number of grooves, width of each groove, wall angle for each groove, etc. is useful to achieve the desired characteristics and performance of the extractor 10. It can be seen that the selection of some of these variables can limit the range of choices available for other of these variables.

As thus configured, when the extractor 10 is positioned over the damaged fastener 30 and is rotated, such as by a tool 20, the ridges 90 engage the damaged fastener 30. As additional torque is applied to the damaged fastener extractor 10, the ridges 90 begin to (a) cut or bite into the damaged fastener 30 and (b) transfer torque to the damaged fastener 30. To facilitate the ability to transfer more and more torque to the damaged fastener 30, the extractor 10 ideally permits material from the head of the damaged fastener 30 to flow along the contours of the extractor inner surface 66; otherwise, too sudden a torque transfer can result in shearing the damaged fastener 30 or further rounding the head of the damaged fastener 30. When the torque thus transferred to the damaged fastener 30 is equal to the torque necessary to remove the damaged fastener 30, the damaged fastener 30 begins to turn and can thereby be extracted.

Figure 13:
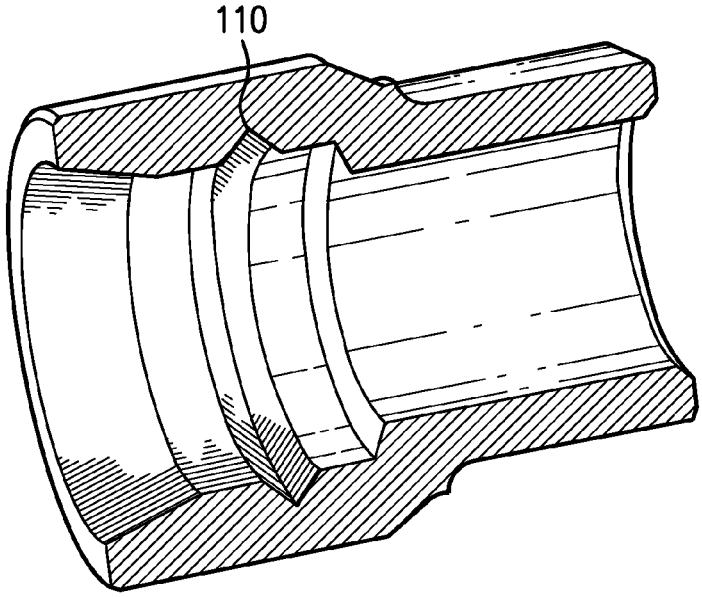
FIG. 13 shows a partially formed embodiment for use in presenting an alternative groove terminus passageway.
Figure 14:
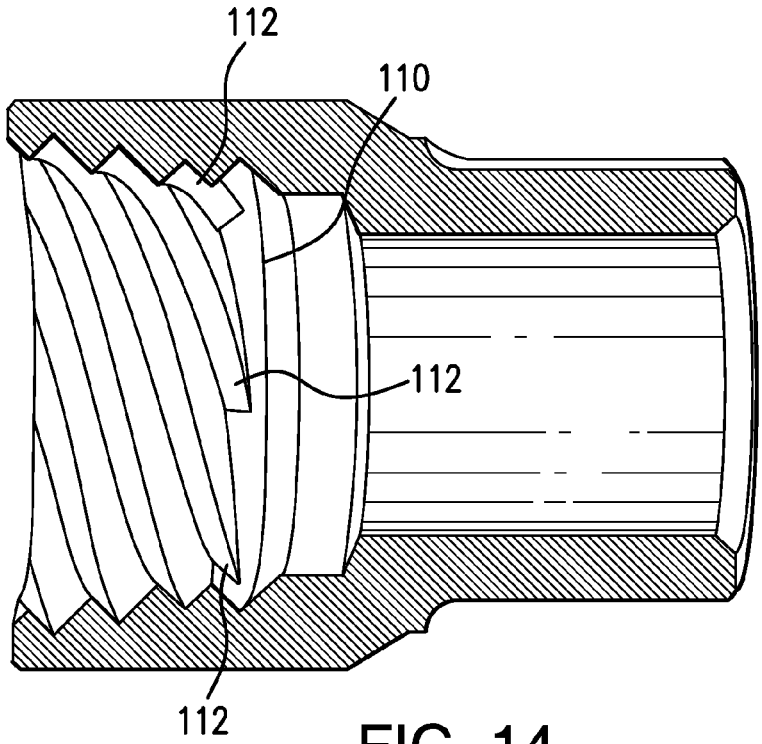
FIG. 14 shows a fully formed embodiment presenting an alternative groove terminus passageway.

Referring now to FIGS. 13 and 14, and alternative embodiment for truncating the grooves 70 is illustrated. In FIG. 13, before the grooves 70 are cut into the extractor, a single, groove-terminating trench 110 is cut. Then, as shown in FIG. 14, the grooves 70 are cut. Those grooves 70 that intersect with the groove-terminating trench 110 thereby terminate at a truncation terminus 112.

Finally, a set of damaged fastener extractors 10 can be provided. In a most preferred embodiment, the damaged fastener extractors 10 are sized differently but otherwise have similar structures and shapes. Again, in a most preferred embodiment, ID is substantially equal to OD, so that the size of the tool 20 that would have fit the damaged fastener 30 had the fastener not been damaged is the same as the size of the tool that will fit the damaged fastener extractor 10. Each damaged tool fastener 10 in the set is then sized so that the dimensions ID, OD for the set correlate with the standard sizes in a set of tools. For example, these could be sized in a set to have dimensions ID, OD equal to 9 mm, 10 mm, 11 mm, 12 mm, 13 mm; 14 mm and 15 mm, or these could be sized in a set to have dimensions ID, OD equal to ¼ inch, ⅜ inch, ½ inch, ⅝ inch, ¾ inch and ⅞ inch.

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless come within the scope of the invention and range of the claims.

What is claimed is:

1. A damaged fastener extractor comprising:

a body defining generally cylindrical coordinates Θ, Z and R about an axis and having a rear body portion communicating with a front body portion;

the rear body portion having an outer surface shaped to be engaged by a tool to be used in rotating the body circumferentially about the axis and sized to present a working outer dimension OD to said tool;

the front body portion having a front terminus and an inner surface;

the front terminus oriented substantially perpendicular to the axis and providing a generally circular receiving aperture communicating with the inner surface;

the inner surface shaped to engage a damaged fastener to be extracted and sized to present a working inner dimension ID to the damaged fastener;

the front body portion inner surface further having N equally spaced, parallel grooves positioned thereon and oriented to extend along an arcuate, inwardly tapering path from a forward groove terminus located proximal to the front body portion front terminus to a rearward groove terminus located proximal to the rear body portion;

each groove having a centerline extending along its length having a pitch P defined by the axial displacement of the centerline per revolution of the centerline about the axis; each groove further having a substantially constant cross-sectional geometry extending along most of its length, whereby the position of each groove centerline at the forward terminus is $\Theta_1$, $Z_1$ and $R_1$ and the position of each groove centerline at the rearward terminus is $\Theta_2$, $Z_2$ and $R_2$; whereby $R_1>ID/2>R_2$; and an angle of inward taper μ is defined by $\tan \mu=(R_1-R_2)/(Z_1-Z_2)$.

2. The damaged fastener extractor of claim 1, ID being substantially equal to OD, whereby the size of the tool that would fit the damaged fastener if the fastener was not damaged is the same as the size of the tool that would fit the damaged fastener extractor.

3. The damaged fastener extractor of claim 1, wherein N=6.

4. The damaged fastener extractor of claim 1, wherein each groove extends along an arc of $\Theta_2-\Theta_1\leq 360$ degrees.

5. The damaged fastener extractor of claim 1, wherein each groove extends along an arc of $\Theta_2-\Theta_1\leq 210$ degrees.

6. The damaged fastener extractor of claim 1, the grooves each further comprising a pair of substantially planar groove walls oriented with respect to one another to form a substantially constant angle $\alpha$ of intersection extending along most of the length of each groove, thereby defining, the substantially constant cross-sectional geometry extending along most of the length of each groove.

7. The damaged fastener extractor of claim 6, wherein the angle $\alpha$ is between about 60 degrees and 120 degrees.

8. The damaged fastener extractor of claim 6, wherein the angle $\alpha$ is about 90 degrees.

9. The damaged fastener extractor of claim 6, wherein the cross-sectional geometry of each groove is V-shaped.

10. The damaged fastener extractor of claim 6, wherein the cross-sectional geometry of each groove has a rounded bottom.

11. The damaged fastener extractor of claim 6, wherein the cross-sectional geometry of each groove has a flattened bottom with sharp corners.

12. The damaged fastener extractor of claim 6, wherein the cross-sectional geometry of each groove has a flattened bottom with rounded corners.

13. The damaged fastener extractor of claim 1, the grooves each further comprising a pair of substantially planar groove walls spaced apart with respect to one another to form a substantially trapezoidal cross-sectional geometry extending along most of the length of each groove.

14. The damaged fastener extractor of claim 1, wherein P/ID is between about 0.50 and about 1.50.

15. The damaged fastener extractor of claim 1, wherein P/ID is between about 0.90 and about 1.10.

16. The damaged fastener extractor of claim 1, wherein the angle of inward taper $\mu$ is between about 20 degrees and about 30 degrees.

17. The damaged fastener extractor of claim 1, wherein the angle of inward taper $\mu$ is about 26 degrees.

18. A damaged fastener extractor comprising:

a body defining generally cylindrical coordinates $\Theta$, Z and R about an axis and having a rear body portion communicating with a front body portion;

the rear body portion having an outer surface shaped to be engaged by a tool to be used in rotating the body circumferentially about the axis and sized to present a working outer dimension D to said tool;

the front body portion having a front terminus and an inner surface;

the front terminus oriented substantially perpendicular to the axis and providing a generally circular receiving aperture communicating with the inner surface;

the inner surface shaped to engage a damaged fastener to be extracted and sized to present a working inner dimension D to the damaged fastener, whereby the size of the tool that would fit the damaged fastener if the fastener was not damaged is the size of the tool that would fit the damaged fastener extractor;

the front body portion inner surface further having six equally spaced, parallel grooves positioned thereon and oriented to extend along an arcuate, inwardly tapering path from a forward groove terminus located proximal to the front body portion front terminus to a rearward groove terminus located proximal to the rear body portion;

each groove having a centerline extending along its length and a pitch P defined by the axial displacement of the centerline per revolution of the centerline about the axis; each groove further having a substantially constant cross-sectional geometry extending along most of its length, whereby the position of each groove centerline at the forward terminus is $\Theta_1$, $Z_1$ and $R_1$ and the position of each groove centerline at the rearward terminus is $\Theta_2$, $Z_2$ and $R_2$; whereby $R_1>D/2>R_2$;

$\Theta_2-\Theta_1\leq 210$ degrees; and an angle of inward taper $\mu$ is defined by $\tan \mu=(R_1-R_2)/(Z_1-Z_2)$.

19. The damaged fastener extractor of claim 18, the grooves each further comprising a pair of substantially planar groove walls oriented with respect to one another to form a substantially constant angle $\alpha$ of intersection extending along most of the length of each groove, thereby defining the substantially constant cross-sectional geometry extending along most of the length of each groove.

20. The damaged fastener extractor of claim 19, wherein the angle $\alpha$ is between about 60 degrees and 120 degrees.

21. The damaged fastener extractor of claim 19, wherein the angle $\alpha$ is about 90 degrees.

22. The damaged fastener extractor of claim 19, wherein the cross-sectional geometry of each groove is V-shaped.

23. The damaged fastener extractor of claim 19, wherein the cross-sectional geometry of each groove has a rounded bottom.

24. The damaged fastener extractor of claim 19, wherein the cross-sectional geometry of each groove has a flattened bottom with sharp corners.

25. The damaged fastener extractor of claim 19, wherein the cross-sectional geometry of each groove has a flattened bottom with rounded corners.

26. The damaged fastener extractor of claim 19, the grooves each further comprising a pair of substantially planar groove walls spaced apart with respect to one another to form a substantially trapezoidal cross-sectional geometry extending along most of the length of each groove.

27. The damaged fastener extractor of claim 18, wherein P/ID is between about 0.50 and about 1.50.

28. The damaged fastener extractor of claim 18, wherein P/ID is between about 0.90 and about 1.10.

29. The damaged fastener extractor of claim 18, wherein the angle of inward taper $\mu$ is between about 20 degrees and about 30 degrees.

30. The damaged fastener extractor of claim 18, wherein the angle of inward taper $\mu$ is about 26 degrees.

31. A set of damaged fastener extractors comprising NN damaged fastener extractors;

each damaged fastener extractor comprising a body defining generally cylindrical coordinates $\Theta$, Z and R about an axis and having a rear body portion communicating with a front body portion;

the rear body portion having an outer surface shaped to be engaged by a tool to be used in rotating the body circumferentially about the axis and sized to present a working outer dimension $D_{NN}$ to said tool;

the front body portion having a front terminus and an inner surface;

the front terminus oriented substantially perpendicular to the axis and providing a generally circular receiving aperture communicating with the inner surface;

the inner surface shaped to engage a damaged fastener to be extracted and sized to present a working inner dimension $D_{NN}$ to the damaged fastener, whereby the size of the tool that would fit the damaged fastener if the fastener was not damaged is the size of the tool that would fit the damaged fastener extractor;

the front body portion inner surface further having six equally spaced, parallel grooves positioned thereon and oriented to extend along an arcuate, inwardly tapering path from a forward groove terminus located proximal to the front body portion front terminus to a rearward groove terminus located proximal to the rear body portion;

each groove having a centerline extending along its length and a pitch P defined by the axial displacement of the centerline per revolution of the centerline about the axis; each groove further having a substantially constant cross-sectional geometry extending along most of its length, whereby the position of each groove centerline at the forward terminus is $\Theta_1$, $Z_1$ and $R_1$ and the position of each groove centerline at the rearward terminus is $\Theta_2$, $Z_2$ and $R_2$; whereby $R_1>D/2>R_2$;

$\Theta_2-\Theta_1\leq 210$ degrees;

an angle of inward taper $\mu$ is defined by $\tan \mu=(R_1-R_2)/(Z_1-Z_2)$;

each damaged tool fastener sized so that $D_1, D_2, \ldots D_{NN}$ correlate with the standard sizes in a set of tools.

32. The set of damaged fastener extractors of claim 31, whereby each damaged fastener extractor groove further comprises a pair of substantially planar groove walls oriented with respect to one another to form a substantially constant angle $\alpha$ of intersection extending along most of the length of each groove, thereby defining the substantially constant cross-sectional geometry extending along most of the length of each groove.

33. The set of damaged fastener extractors of claim 32, whereby each damaged fastener extractor angle $\alpha$ is between about 60 degrees and 120 degrees.

34. The set of damaged fastener extractors of claim 32, whereby each damaged fastener extractor angle $\alpha$ is about 90 degrees.

35. The set of damaged fastener extractors of claim 32, whereby each damaged fastener extractor groove cross-sectional geometry is V-shaped.

36. The set of damaged fastener extractors of claim 32, whereby each damaged fastener extractor groove cross-sectional geometry has a rounded bottom.

37. The set of damaged fastener extractors of claim 32, whereby each damaged fastener extractor groove cross-sectional geometry has a flattened bottom with sharp corners.

38. The set of damaged fastener extractors of claim 32, whereby each damaged fastener extractor groove cross-sectional geometry has a flattened bottom with rounded corners.

39. The set of damaged fastener extractors of claim 32, whereby each damaged fastener extractor groove comprises a pair of substantially planar groove walls spaced apart with respect to one another to form a substantially trapezoidal cross-sectional geometry extending along most of the length of each groove.

40. The damaged fastener extractor of claim 31, wherein P/ID is between about 0.50 and about 1.50.

41. The damaged fastener extractor of claim 31, wherein P/ID is between about 0.90 and about 1.10.

42. The set of damaged fastener extractors of claim 31, whereby each damaged fastener extractor angle of inward taper $\mu$ is between about 20 degrees and about 30 degrees.

43. The set of damaged fastener extractors of claim 31, whereby each damaged fastener extractor angle of inward taper $\mu$ is about 26 degrees.

* * * * *